US011638944B2

(12) United States Patent
Lisciani et al.

(10) Patent No.: US 11,638,944 B2
(45) Date of Patent: May 2, 2023

(54) DEVICE FOR MECHANICAL CLEANING OF WIRE RODS FOR THE PRODUCTION OF DRAWN METALLIC WIRES

(71) Applicant: LISCIANI TECHNOLOGIES S.R.L., Grottammare (IT)

(72) Inventors: Giulio Lisciani, Grottammare (IT); Mohamad El Mehtedi, Ancona (IT)

( * ) Notice: Subject to any disclaimer, the term of this patent is extended or adjusted under 35 U.S.C. 154(b) by 102 days.

(21) Appl. No.: 17/296,678

(22) PCT Filed: Nov. 26, 2019

(86) PCT No.: PCT/EP2019/082544
§ 371 (c)(1),
(2) Date: May 25, 2021

(87) PCT Pub. No.: WO2020/114832
PCT Pub. Date: Jun. 11, 2020

(65) Prior Publication Data

US 2022/0016681 A1 Jan. 20, 2022

(30) Foreign Application Priority Data

Dec. 3, 2018 (IT) ..... 102018000010644

(51) Int. Cl.
*B21C 43/04* (2006.01)
*B08B 1/02* (2006.01)

(52) U.S. Cl.
CPC ..... *B21C 43/04* (2013.01); *B08B 1/02* (2013.01)

(58) Field of Classification Search
CPC ..... B21C 43/04
See application file for complete search history.

(56) References Cited

FOREIGN PATENT DOCUMENTS

| | | | |
|---|---|---|---|
| DE | 7019472 | U | 8/1970 |
| DE | 10224603 | A1 | 1/2004 |
| EP | 0630697 | A2 | 12/1994 |
| EP | 0931601 | A1 | 7/1999 |
| EP | 1110638 | A2 | 6/2001 |

OTHER PUBLICATIONS

International Search Report for corresponding PCT/EP2019/082544, dated Feb. 13, 2020.
Written Opinion of the International Searching Authority for corresponding PCT/EP2019/082544, dated Feb. 13, 2020.

*Primary Examiner* — Natasha N Campbell
(74) *Attorney, Agent, or Firm* — Egbert, McDaniel & Swartz, PLLC

(57) ABSTRACT

A device for the mechanical cleaning of wire rods for the production of drawn metallic wires includes a pair of elements supported by a shaft, each element having a truncated-conical body and a flat disk that closes the truncated-conical body, defining an internal annular space that contains the steel wool. The flat disk has openings that are shaped as a slot. The two elements being disposed one in front of the other, with a space between the two flat disks. During operation, by rapid rotation of the shaft, the steel wool expands under the effect of a centrifugal force in radial direction, thus creating an axial thrust component on the steel wool such that the steel wool escapes partially and elastically from the openings of the flat disks so that the steel wool brushes against the surface of the wire rod in transit in the space between the two elements.

8 Claims, 4 Drawing Sheets

DEVICE FOR MECHANICAL CLEANING OF WIRE RODS FOR THE PRODUCTION OF DRAWN METALLIC WIRES

The present invention relates to the mechanical cleaning of ferrous and non-ferrous metal wire forming a semi-finished product produced in coils by means of hot rolling, which is usually defined as wire rod, and intended for the production of drawn products.

Drawing is a cold process that consists in passing a wire through a die with a smaller section than the wire, which assumes the same shape as the die because of plastic deformation. Such a process can be repeated in subsequent steps until a wire with a desired diameter or profile is obtained, which can be different from the round shape.

Drawing is a very simple technological process, which has been known since ancient times to draw metals and has never changed conceptually. On the other hand, the boundary conditions have changed, making this process more and more efficient and cost-effective.

During the passage of the hot semi-finished products to the cold working, which is typical of the drawing process, the wire must be adequately prepared by accurately removing an aggregate of oxides and hydroxides that is inevitably formed on the surface of the material at high temperature in a damp, oxidizing environment, such as the natural atmosphere.

In ferrous materials, such an aggregate is composed of chemically and physically diversified layers, ranging from superficial oxidation to the formation of very minute, powdery and extremely adherent scales housed within the typical craterings of a laminated surface, up to millimeter dimensions, which are puff-shaped, crusty and very brittle. In the various chemical and physical forms, these scales are hard and remarkably abrasive.

A removal of these formations is necessary before drawing because, in addition to being an unwanted component for the quality of the product, the presence of these formations determines a rapid wear of the die, a strong limitation of the working speed, a substantial limitation of the efficiency of the systems, and very importantly, a conditioning to any further processing after the drawing process.

According to the prior art, such a preparation is performed with operating methods that are essentially attributable to two conceptual principles, which respectively correspond to methods of chemical or mechanical type.

The chemical methods are implemented by means of processes that basically perform a wet pickling of the wire rod. These techniques offer very high-quality levels of cleaning and preparation, with the application of particular compounds, which are optimal for drawing. However, they entail considerable installation costs, and especially management costs, because a rigorous treatment of the waste water is mandatory to guarantee compliance with the anti-pollution parameters. Nevertheless, in spite of an unquestionable quality of the products, these chemical methods are relentlessly regressing at worldwide level and are exclusively reserved to strategic materials with a high technological profile.

In spite of the lower cleaning quality, the mechanical methods are increasingly acquiring a predominant role in large-scale product consumption because of the simplicity of the devices and of the low operating costs that are especially determined by a limited environmental impact. Furthermore, production users are increasingly demanding and pretending high-performing results that are similar to the yield of the chemical method also at qualitative level. It goes without saying that this only applies to cleaning, since the mechanical method is exclusively a removal method, whereas the preparation for drawing, with the addition of specific products, evidently requires a chemical method, the efficiency of which depends on the accuracy of the surface preparation. At present, a multitude of techniques of different kind are proposed and compared based on cost-effectiveness, in terms of both installation and operation, and effectiveness. However, effectiveness is generally not reconciled with the desirable cost-effectiveness in terms of investment and management.

The most interesting and most popular techniques of the prior art, which will be briefly described below, are characterized by advantages and, inevitably, by disadvantages that must be carefully evaluated when making a choice.

Almost all of these techniques involve a multi-stage treatment. A first preliminary stage that is common to all methods consists in the removal of the outer, coarse and easily removable scale. Such a first stage takes place in a relatively simple way by breaking the scale, alternately bending the wire rod, which is uncoiled and pulled by the drawing machine, with passages on different rollers arranged sequentially and lying in the space on different planes.

Although the calamine is removed almost completely in this stage, the remaining quantity is small, but difficult to remove. This is the aspect in which the various methods differentiate.

A very important and accredited method consists in sanding or shot blasting, wherein abrasive grains are ejected at high speed onto the surface of the wire rod, being conveyed by a flow of air generated by turbines. The quality of such a method is very high, given that the grains are able to penetrate right into the lamination craterisations and expel even the smallest calamine residues, while adapting to any form of material shape. Conversely, costs are high both for the installation, which is structured in a very complex set of components, and for the management because of the low yield, due to the limited surface exposed to the abrasive flow and, above all, due to the considerable energy expenditure.

Other systems provide for using different types of abrasives that are directly applied with rigid or flexible supports. Said systems can be either dynamic, wherein a rotational or sliding motion is combined with the movement of the wire, or static systems, wherein the abrasion action solely occurs because of the forward movement of the wire rod.

The multiplicity of systems is truly varied and each one of them is characterized by its own specificity. Among these, a family of devices is distinguished for its diffusion and application variants, which use rapidly rotating circular steel brushes that act in tangent direction with the tip, with elementary wires, on the external part of the wire rod to be treated. Furthermore, a new family of devices has recently been added, which uses abrasive bands in sliding and in planetary rotation on the axis of the wire rod. It is an effective, yet especially expensive technique.

Another system consists in the use of steel wool as abrasive, in loose form and unconstrained by any reinforcement, as for the aforementioned brushes. The use of such an abrasive has numerous advantages, even considerable ones, compared to the methods described:

- economical product especially due to its loose form;
- lack of restraint structures, such as reinforcements, which constitute a cost that does not contribute to the quality yield of the abrasive;

no need to dispose of the restraint structures at the end of the work cycle, which cannot be recycled if they are made of non-metallic materials, such as flexible supports, bands and strips;

almost complete utilization of all the quantity in use;

complete recycling of the waste that can be mixed with the waste of the material being processed because of the same nature.

In the name of the same applicant, EP0931601 and EP1110638 disclose devices for the cleaning of wire rods that use steel wool manually wrapped around a wire and clamping jaws that apply pressure on the steel wool.

In the name of the same applicant, EP0630697 discloses a device used to apply pressure on the steel wool.

The devices described in EP0931601, EP1110638 and EP0630697 adopt a system of clamping jaws suitable for confining the steel wool in a volume around the profile of the wire rod and for applying such a pressure to induce an abrasion action on the surface of the wire in transit with the lateral cutting edges of the thin strip that forms it into the shape of a blade. The abrasive effect is determined by both the applied pressure and, above all, the relative speed of the cutting edge with respect to the surface of the material. In EP0931601 and EP1110638 the abrasive effect is exclusively given by the speed of the wire rod in transit, wherein in EP0630697 the abrasive effect is combined with a rotational movement that depends on the rotational speed of the rotor, which supports and confines the steel wool, and on the diameter of the wire rod that, in this case, must necessarily have a circular profile.

Evidently, in EP0931601 and EP1110638, the cutting speed is not very high, depending on the specifications of the drawing machine and on the process; also in EP0630697, in spite of having a high rotational component, the cutting speed can never reach very high levels due to the intrinsic smallness of the wire diameter.

In fact, the quality of the treated material depends on many factors, above all its composition, the type of cooling during the rolling stage and the exposure to atmospheric elements during storage. In many cases these real limitations do not prevent a general good result, always relative to the destination of the final product, especially in view of the incomparable simplicity and operating economy.

DE7019427U and DE10224603A1 disclose different devices wherein a glass wool container is rotated around a wire.

The purpose of the present invention is to eliminate the drawbacks of the prior art, by disclosing a device for the mechanical cleaning of wire rods for the production of drawn metallic wire that is efficient, effective and reliable.

Another purpose is to disclose such a device for the mechanical cleaning of wire rods that is versatile and simple to make and use.

These purposes are achieved in accordance to the invention with the characteristics of the independent claim 1.

Advantageous embodiments of the invention appear from the dependent claims.

The device for the mechanical cleaning of wire rods according to the invention is defined by the independent claim 1.

The adoption of steel wool is more attractive than the prior art and a more effective effect is desirable for cases where a better finishing is required.

The present invention provides for applying the steel wool in loose form at high speed.

Due to its loose state, the steel wool must be contained in a defined volume, i.e. a container, which is closed around the wire in the case of the aforementioned applications. However, if a high relative speed is to be achieved, this container must be inevitably freed from the wire and external, similarly to a brush, but without reinforcements or prefabricated structures. Furthermore, in order to exert its action on the wire rod, the abrasive must come into contact with the wire rod through appropriate openings. Consequently, the container cannot be completely closed.

In conditions of rapid rotation within such a volume, for geometrical reasons of annular conformation, centrifugal forces are generated, which increase with the distance from the axis of rotation and with the square of the angular velocity. With the same peripheral speed of a generic portion of abrasive, the higher the size of the radius of curvature of the trajectory, the lower said forces will be. However, since the physical dimensions of the device must be limited, for convenience and practicality of use, the forces acting on the loose mass are of considerable value, and therefore the loose mass must be constrained, necessarily excluding circumferential openings of any type to prevent the loose mass from escaping and being subsequently broken down.

Additional characteristics of the invention will appear manifest from the following description, with reference to the appended drawings, which are a merely illustrative and not limiting embodiment, wherein.

With reference to the figures of the appended drawings, the invention relates to a device (1) for the mechanical cleaning of a wire rod (20) used in particular for the production of metal wires by means of drawing.

Figure 1:
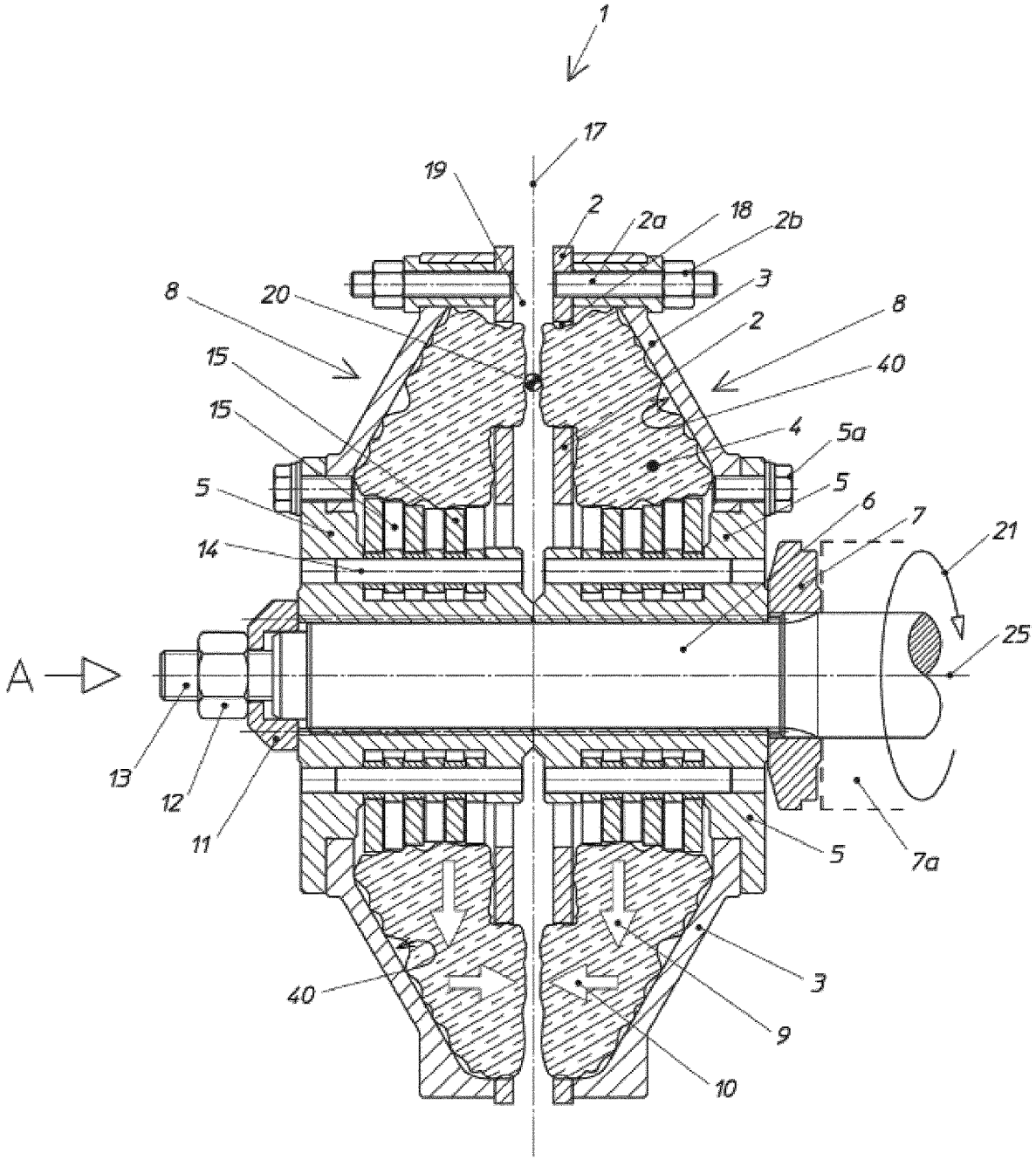
FIG. 1 is a sectional view of the device according to the invention taken along a sectional plane perpendicular to the forward traveling direction of the wire rod.

With reference to FIG. 1, the device (1) basically comprises two similar shell-shaped independent elements (8).

A shaft (6) supports the elements (8) in specular position relative to a plane of symmetry (17). The elements (8) can be easily removed from the shaft (6). The elements (8) are mounted in an assembly between an adapter (11) and a spacer (7) and are tightened on the shaft (6) by means of a nut (12) and a stud bolt (13).

The shaft (6) is revolvingly supported by rolling bodies on a suitable structure (7*a*) (shown with a broken line), in such a way that the shaft (6) can rotate at a high speed, for example in the direction of the arrow (21).

Each element (8) comprises components that define a compartment (40) where an agglomerate abrasive material, such as steel wool (4), is housed. The steel wool (4) is the active abrasive component.

A hub (5) is coupled with the shaft (6).

Figure 2:
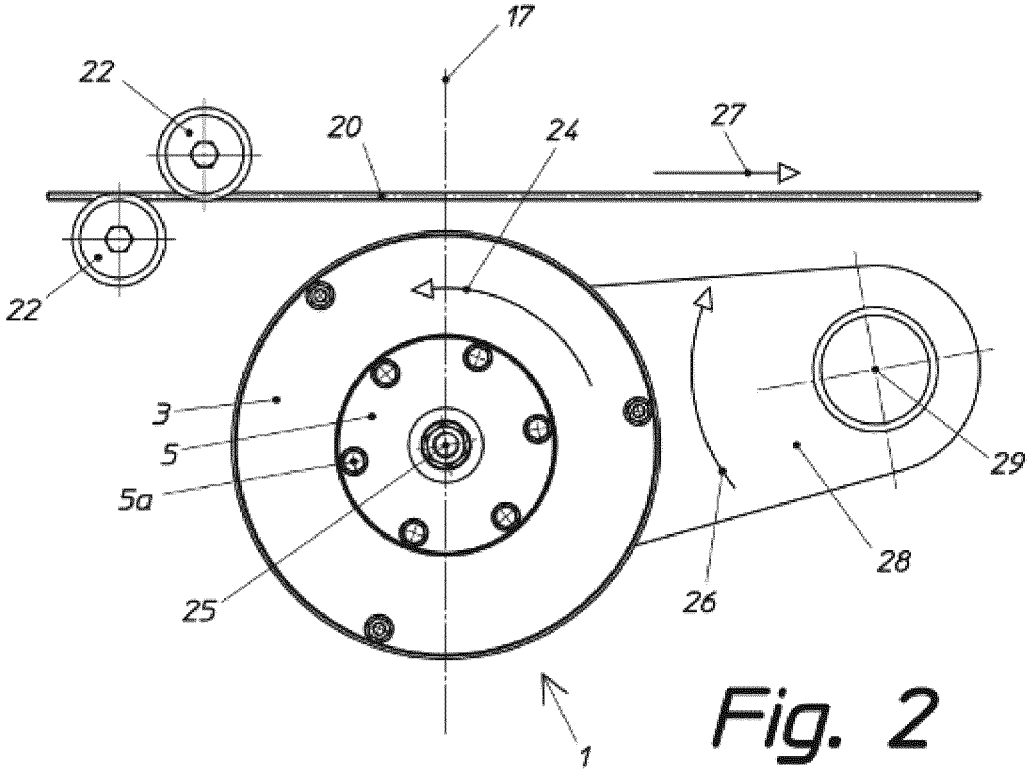
FIGS. 2 and 3 are front views of the device of FIG. 1 taken along the direction of arrow A of FIG. 1, which illustrate the device in a non-operating and an operating position, respectively.
Figure 3:
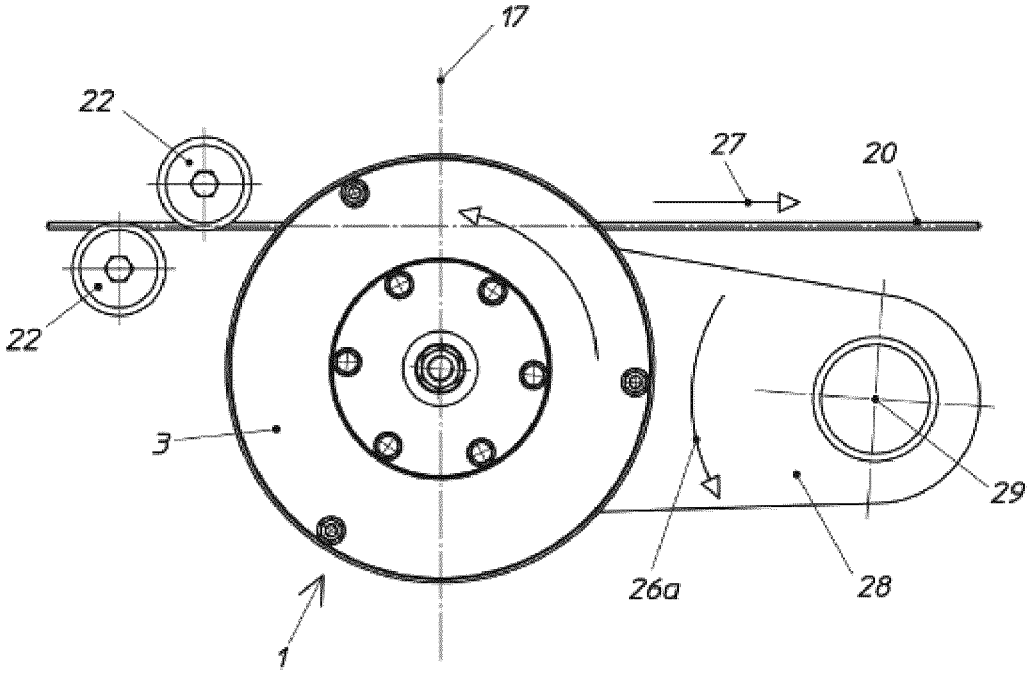

With reference to FIGS. 1-3, each element (8) comprises: a truncated-conical disk (3) integral with the hub (5) and a flat disk (2) that closes the truncated-conical disk (3).

Advantageously, the shaft (6) and the hub (5) are of splined type for a splined coupling.

Figure 5:
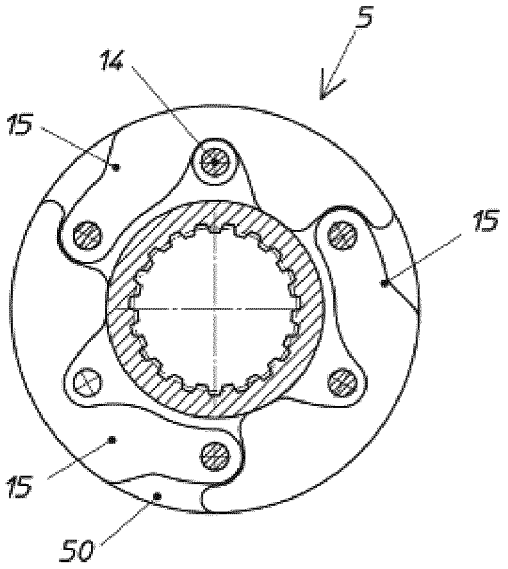
FIG. 5 is a cross-sectional view of a hub of the device of FIG. 1, when the device is stopped.
Figure 6:
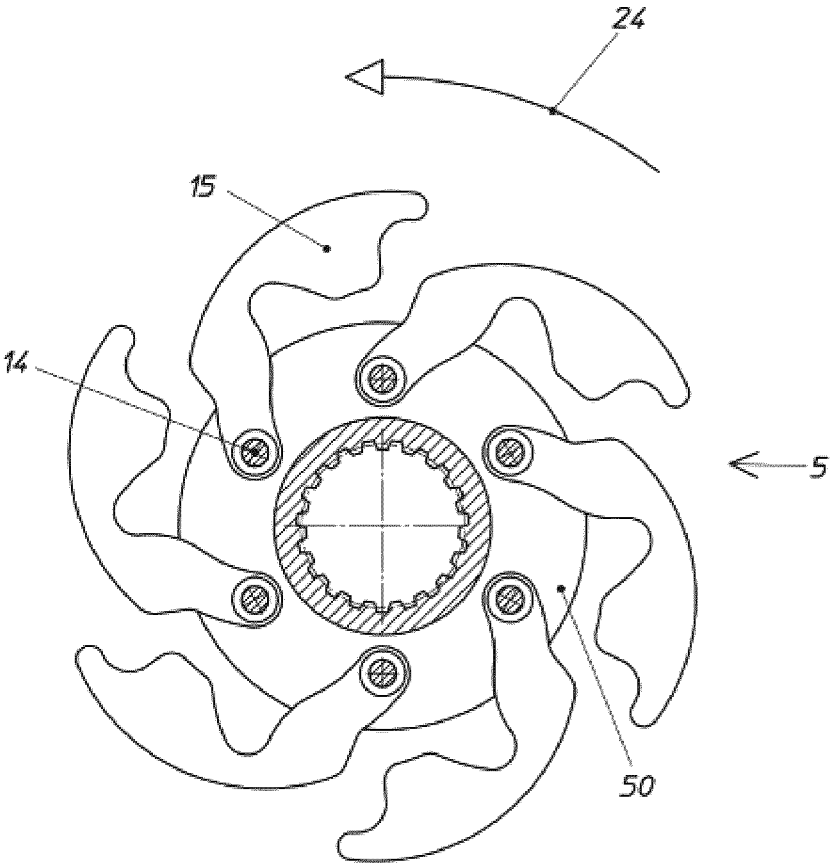
FIG. 6 is a cross-sectional view of the hub of FIG. 5 during a rotation of the device.

With reference to FIGS. 5 and 6, the hub (5) comprises a cylindrical body (50) and a plurality of oscillating masses (15) fixed to the cylindrical body (50) by means of pins (14) disposed in eccentric peripheral positions of the cylindrical body (50).

Figure 4:
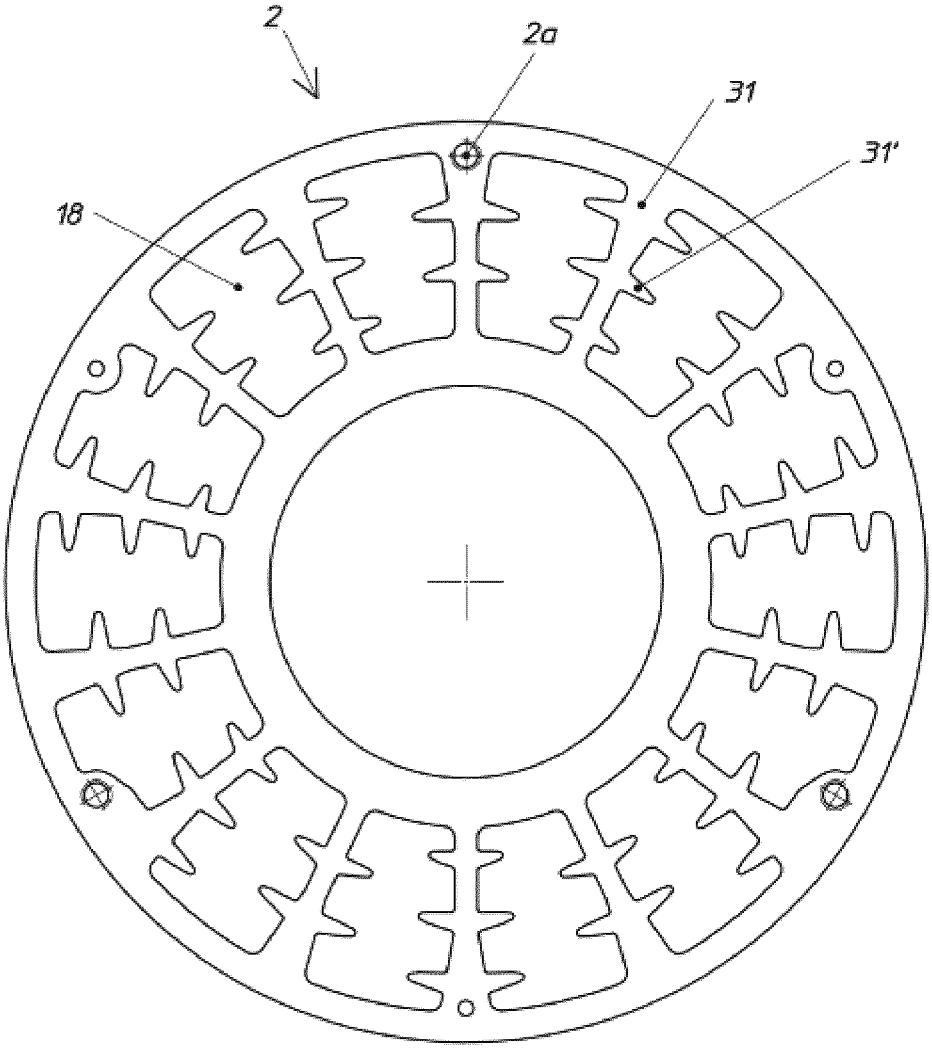
FIG. 4 is a side view of a flat disk of the device of FIG. 1.

FIG. 4 illustrates the conformation of the flat disk (2) that has a disc-like shape provided with a plurality of openings (18) shaped as a slot. Each opening (18) is defined by spokes (31) with a plurality of ribs (31') orthogonal to the spoke (31) that protrude from the spokes (31) inside the openings (18).

With reference to FIG. 1, the flat disk (2) is integral with the truncated-conical body (3) by means of stud bolts (2*a*) and nuts (2*b*). The flat disk (2) and the truncated-conical body (3) define the compartment (40) that houses the steel wool (4). The removal of the flat disk (2) provides access to the compartment (40) of the element (8) in order to fill the compartment (40) with the steel wool (4).

A space (19), which is wider than the diameter of the wire rod (20), remains between the flat disks (2) of the two elements (8). In view of this, the wire rod (20) can be inserted in the space (19) without obstacles or interferences. As a matter of fact, the wire rod (20) exclusively interferes with the steel wool (4) that comes out of the openings (18) of the flat disk (2).

The shaft (6) rotates at high speed around its rotation axis (25) along the rotational direction (21) or in opposite direction. The rotation of the shaft (6) drives the two elements (8) into rotation.

During the rotation of the two elements (8), centrifugal forces (9) are exerted on the steel wool (4), expanding the steel wool (4) radially outwards.

Given the tapered conformation of the truncated-conical body (3), the steel wool (4) is wedged radially into an ever-smaller volume of the element, generating an axial component (10) that pushes the steel wool (4) towards the flat disk (2).

Such an axial component (10) forces the steel wool (4) to come out of the holes (18) of the flat disk (2). Due to the particular shape of the openings (18) of the flat disk (2) and to the elastic property of the steel wool, the steel wool (4) is only partially ejected into bulges that escape from the openings (18) of the flat disk (2), partially occupying the space (19) that is transversely crossed by the wire rod (20) in a skewed direction with respect to the axis of rotation (25) of the shaft.

Because of the rotation of the device (1), the steel wool pads that are extroflected from the openings (18) of the flat disk (2) interfere with the rod wire (20) in transit, in a controlled manner, exerting a simultaneous rubbing on the two opposite sides.

The abrasive effect of the steel wool (4) is directly correlated with the contact speed of the cutting edges of the steel wool, and with the surface of the wire rod in contact with the cutting edges of the steel wool. Such a contact speed depends on the rotational speed of the device (1) and on the distance of the wire rod (20) from the axis of rotation (25) of the shaft (6).

The value of the forces applied on the steel wool mass also depends on the angular velocity of said steel wool mass. Such an angular velocity of the steel wool mass cannot be excessively high to avoid instability phenomena due to cohesion failure and consequent uncontrolled expulsion of steel wool parts.

However, it is essential to ensure an axial thrust such as to extroflect the steel wool through the openings (18) of the flat disk (2). The centrifugal forces (9) that are inertially created on the low density mass of the steel wool, at a safety rotational regime, are insufficient to ensure a stable and reliable working equilibrium during operation.

For this reason, it is necessary to create an additional controllable centrifugal thrust. Such an additional centrifugal thrust is given by the construction of the hub (5) that incorporates the oscillating masses (15).

With reference to FIG. 5, in idle conditions, the oscillating masses (15) adhere to the cylindrical body (50) of the hub.

With reference to FIG. 6, when the hub (5) rotates in the direction of the arrow (24), the oscillating masses (15) expand radially, partially occupying the compartment (40) of the elements (8) that contain the steel wool (4), creating a thrust with the adjustable and predictable axial component (10).

In view of the above, the efficiency of such a device is manifest, it being able to maintain control of a loose and non-compact mass, such as the steel wool, subject to disintegrating forces, and to exploit the high effectiveness of the high-speed abrasion process of the steel wool.

FIGS. 2 and 3 illustrate a practical application of the device (1) mounted on a mobile support (28), for instance an oscillating support around an axis (29). The mobile support (28) allows a rapid access to the elements of the device (1) in order to refill the steel wool and facilitate an insertion step of the wire rod (20) in the space (19).

The wire rod (20) travels in forward direction with a continuous movement along the forward traveling direction indicated by the arrow (27) towards a drawing machine installed downstream the device (1). The wire rod (20) is driven by pulleys (22).

FIG. 2 shows the device (1) in non-operating position, wherein the wire rod (20) is not in the space (19) of the device.

By rotating the mobile support (28) around the axis of rotation (29) in the direction of the arrow (26), the device (1) passes from the non-operating position to an operating position (shown in FIG. 3) wherein the wire rod (20) is in the space (19) of the device.

With reference to FIG. 3, by rotating the mobile support (28) around the axis of rotation (29) in the direction of the arrow (26*a*), the device (1) passes from the operating position to the non-operating position (shown in FIG. 2) wherein the wire rod (20) is not in the space (19) of the device.

A system can comprise a plurality of devices (1). Each device (1) is sequentially applied along a forward traveling direction of the wire rod (20) and on different working planes that are parallel to the axis of the wire rod in order to increase the cleaning effect and the uniformity on the entire circumference of the profile of the wire rod.

The invention claimed is:

1. Device for mechanical cleaning of wire rods for production of drawn metallic wires, comprising a pair of elements supported by a shaft, each element comprising a truncated-conical body and a flat disk that covers the truncated-conical body, defining an internal annular space that contains steel wool;

the flat disk being provided with openings shaped like a slot;

the two elements being disposed one in front of the other along a plane of symmetry, wherein a space is provided between the two flat disks, said space being suitable for receiving said wire rod;

wherein, during the operation, by means of a rapid rotation of the shaft, said steel wool expands under the effect of a centrifugal force in radial direction, thus creating an axial thrust component on said steel wool towards said flat disks in such a way that said steel wool escapes partially and elastically from the openings of the flat disks, so that the steel wool brushes against the surface of the wire rod that is in transit in the space between the two elements, thus producing a cleaning action on the surface of the wire rod in contact with the steel wool by means of high-speed rubbing.

2. The device of claim 1, wherein the elements are independent and removable from the shaft.

3. The device of claim 1, also comprising a hub fixed to said shaft, said hub supports masses; said masses expand radially during a rapid rotation of the shaft, thus creating additional forces for stabilizing the steel wool during rotation and ensuring a sufficient axial thrust.

4. The device of claim 3, wherein said hub and said shaft are splined.

5. The device of claim 3, wherein said hub comprises a cylindrical body and a plurality of oscillating masses connected to the cylindrical body by means of pins disposed in eccentric peripheral positions of the cylindrical body.

6. The device of claim 1, wherein said flat disks have a disc-like shape and comprise a plurality of spokes with a plurality of ribs that protrude from the spokes inside the openings.

7. The device of claim 1, also comprising a mobile support to provide a fast access to its parts in order to refill the steel wool and facilitate an insertion step of the wire rod.

8. System comprising a plurality of devices according to claim 1, wherein each device is applied sequentially along a forward traveling direction of the wire rod and on different working planes parallel to the axis of the wire rod in order to increase the cleaning effect and the uniformity on the entire circumference of the profile of the wire rod.

* * * * *